United States Patent [19]

Silver

[11] 4,046,308

[45] Sept. 6, 1977

[54] PACKAGING

[75] Inventor: Stanley Milton Silver, London, England

[73] Assignee: Paxall, Inc., Chicago, Ill.

[21] Appl. No.: 234,105

[22] Filed: Mar. 13, 1972

[30] Foreign Application Priority Data

| | | |
|---|---|---|
| Mar. 24, 1971 | United Kingdom | 7709/71 |
| Apr. 21, 1971 | United Kingdom | 10351/71 |
| Apr. 21, 1971 | United Kingdom | 10352/71 |
| June 9, 1971 | United Kingdom | 19550/71 |

[51] Int. Cl.[2] ..... B65D 5/72; B65D 5/02

[52] U.S. Cl. ..... 229/17 R; 229/37 R; 229/14 BL; 229/38; 229/14 BA; 428/35; 428/36; 428/126; 428/43; 428/542; 93/39 R; 93/44.1 R; 93/55.1 R; 93/DIG. 1

[58] Field of Search ..... 161/117, 109, 44; 229/37 E, 37 R, 38, 39 R, 17 R, 21, 14 BA, 14 BL; 428/35, 36, 43, 126, 127, 128, 129, 542

[56] References Cited

U.S. PATENT DOCUMENTS

| | | | |
|---|---|---|---|
| 2,473,391 | 6/1949 | Roselle | 229/17 R |
| 2,764,069 | 9/1956 | Guyer | 156/247 |
| 2,792,166 | 5/1957 | Brooks | 229/17 R |
| 3,094,265 | 6/1963 | Houland | 229/37 R |
| 3,106,330 | 10/1963 | Rausing | 229/14 BA |
| 3,411,694 | 11/1968 | Silver | 229/37 R |
| 3,561,667 | 2/1971 | Saltman | 229/37 R |
| 3,577,699 | 5/1971 | Silver | 53/284 |
| 3,616,987 | 11/1971 | Krzyzanowski | 229/17 R |
| 3,661,321 | 5/1972 | Tessmer | 229/17 R |
| 3,829,005 | 8/1974 | Hackenberg et al. | 229/14 BL |
| 3,877,630 | 4/1975 | Silver | 428/43 |
| 3,883,068 | 5/1975 | Silver | 229/14 BA |

*Primary Examiner*—George F. Lesmes
*Assistant Examiner*—William R. Dixon, Jr.
*Attorney, Agent, or Firm*—Fitch, Even, Tabin & Luedeka

[57] ABSTRACT

A blank which is capable of producing a tube of moisture-resistant material which may be end sealed to form a package. The blank comprises a substratum of card or the like with a delaminable sheeting thereon. The blank has fold lines defining opposable body walls and at least one end closure panel. Flange panels are defined with extensions and allow the formation of a sealable fin. Apparatus and method are provided for side seaming such a blank with outfolding of panels to fuse the sheeting into a tube and delaminate the sheeting from the substratum. Apparatus and method are also provided for end sealing such a tube, with provision for outfolding of gussets and fusion and delamination of the sheeting to provide an end membrane delaminated from the substratum.

10 Claims, 12 Drawing Figures

Figure 1:
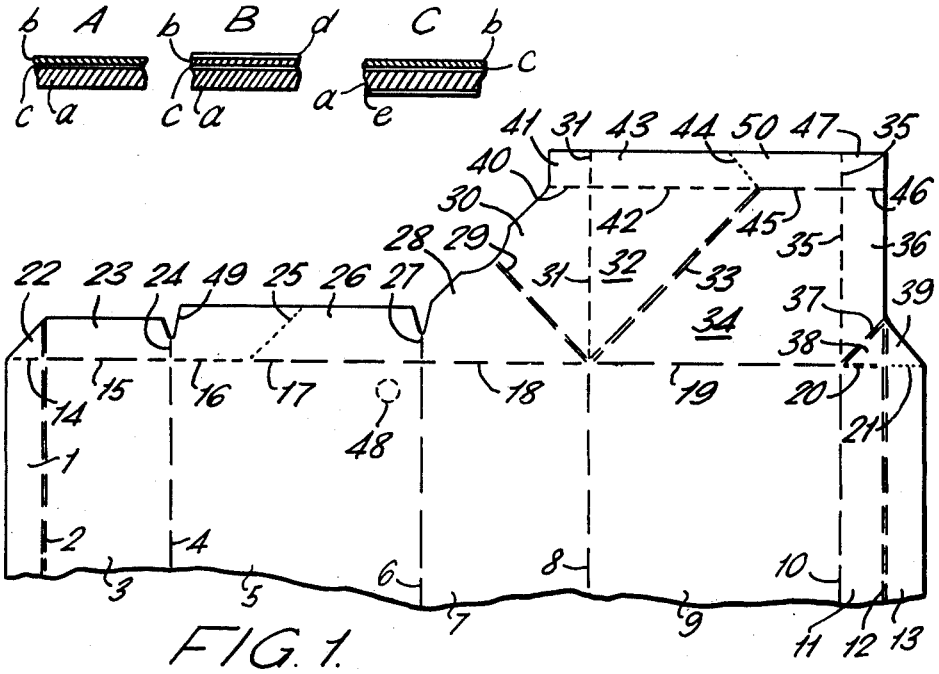

FIG. 4.
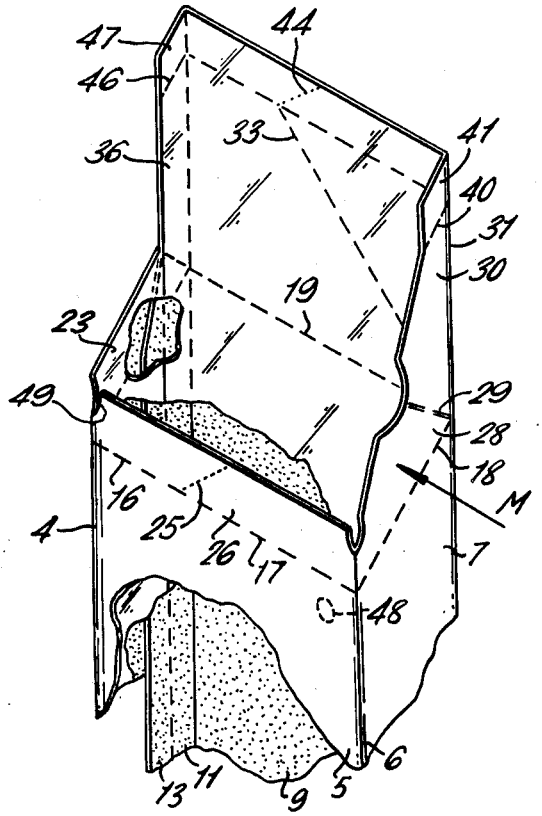
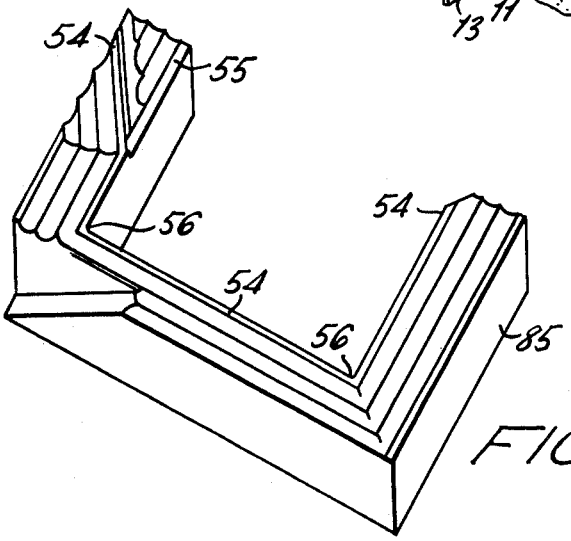
FIG. 5.

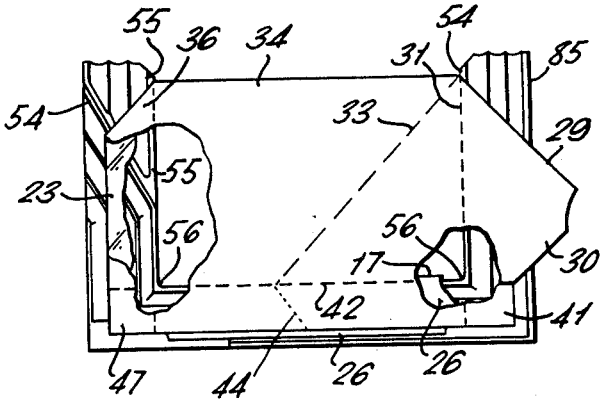
FIG. 6.
FIG. 7.
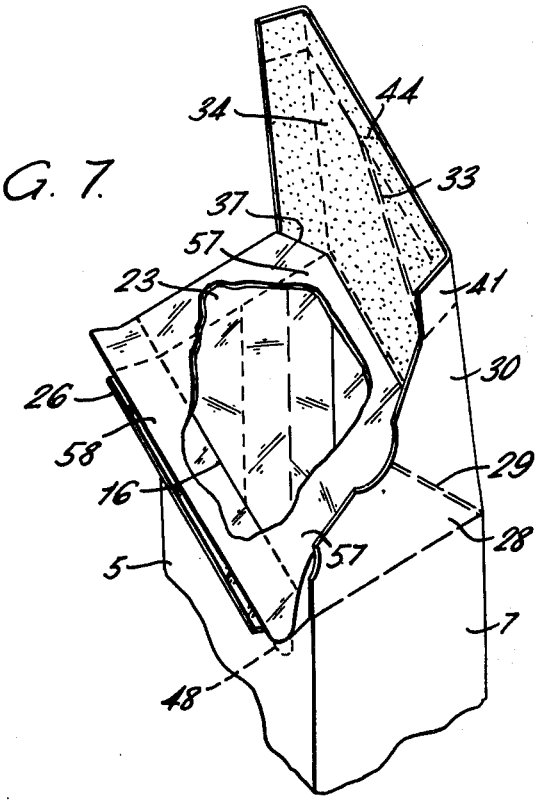

PACKAGING

This invention relates to packaging and more specifically to barrier wrapping or cartoning from blanks with methods and apparatus capable of producing a tube of moisture resistant pack lining material (hereinafter referred to as sheeting) within a tube of paper, cardboard, boxboard or the like (hereinafter referred to as a substratum) and methods and apparatus adapted to convert this lined tube into a double-walled package such as a carton or wrapper.

Prior methods and apparatus used to accomplish the above have certain disadvantages. This includes my earlier work as represented by U.K. Pat. No. 1176796 relating to blanks of unitary sheet material processed for use in packaging.

My earlier packages have heretofore been unable to provide integral means that would permit easy opening and reclosure. A further disadvantage is that my earlier solutions did not permit ready co-operation with either standard side-seaming or end sealing machines or required apparatus of completely novel design.

The present invention is concerned with side seaming and end sealing to convert a blank substantially of the type described herein and assemble same into partial or complete pack form. Moreover the invention concerns not only co-operating and/or independent equipment but also the means by which standard side seaming and end sealing machines may be modified to adopt the novelty.

In my earlier inventions I produced side and end seals employing heat which simultaneously released the sheeting from the substratum. I have since discovered that an improved manner to mechanically produce such a double-walled package is to form a fin (or fins), said fin (or fins) to be angularly positioned (e.g. 30° to 90°) in relation to a pair of parallel body face panels whilst heat sealing.

According to one aspect of the invention there is provided a flat or folded blank with heat-sealable characteristics suitable for packaging, said blank being formed from a sheet of laminated material comprising a substratum of paper, cardboard, boxboard or the like and sheeting of pack-lining material de-laminably adhered to the substratum by a moisture-resistant heat weakenable laminant, such as microcrystalline wax, said sheeting surface having pressure-cohesive characteristics when heated; wherein said blank has fold lines defining at least two pairs of opposable body walls and at least one foldable end closure panel connected to each body wall end, and wherein at select opposable edge margin areas of the blank, fold lines define flange panels, at least one of which flange panels has extensions and at least one of which flange panels is connected to a body wall, the aggregate of a said flange panel and extensions being of greater length than the edge of a said body wall parallel thereto, and at least a pair of flanges being sufficiently cut free on three edges to permit folding into a sealable fin.

In accordance with one embodiment the blank comprises opposable first and further side fin flange panels co-operable to form a side fin, and wherein an end closure panel includes a main closure panel, lateral gussets and a flange closure panel at least almost wholly cleanly laterally severed therefrom for forming a heat-sealed joint co-extensive with the gussets at the corners of an erect package.

Conveniently said blank comprises, as said body walls, two face panels, an unseamed side panel and a seamed side panel formable from a part side panel with a said first side fin flange panel and from a seaming flange panel, and a said further side fin flange panel whereby on interengagement of the side fin flange panels there is formed a said fin disposable angularly or in a different plane with respect to the face and side panels.

According to another aspect there is provided a method of side-seaming such a blank, said method including the steps of folding the said blank such as to bring the roots of the side fin flange panels into interengagement, applying heat and pressure to at least said roots to cause their sheeting to fuse, heating and outfolding one side fin flange panel and an adjacent panel to strip the sheeting therefrom and folding and adhering regions of the stripped substratum to an opposed panel or panels thereby to define a substratum tube around a sheeting tube.

There is also provided a side-seaming apparatus comprising means for folding the said blank such that the side fin flange panel roots are brought into interengagement, means for applying heat and pressure to at least said roots, means for applying heat to the area of one side fin flange panel and an adjacent flange panel, means for outfolding the side fin flange panel and adjacent panel to strip the sheeting therefrom and means to fold and adhere regions of the stripped substratum to an opposed panel or panels thereby to define a substratum tube around a sheeting tube.

According to another aspect of the invention there is provided a method of end sealing such a side-seamed blank comprising the steps of down-folding the main closure panel with outfolding of the gussets and outfolding of the flange closure panel, applying heat and pressure to at least partly seal the sheeting thereof and so define an at least partially sealed end membrane, lifting the said main closure panel to strip it from the said end membrane, infolding the gussets and infolding the flange closure panel, downfolding the stripped main closure panel and sealing down the said folded-down main closure panel.

There is also provided an end sealing apparatus comprising a pocket member adapted to receive a said side-seamed tube and to embrace side and face panels thereof and underlie selected end closure panels means for downfolding the main closure panel and outfolding the gussets and flange closure panel, means for applying heat and pressure to regions of the blank in cooperation with the said pocket member whereby to seal the sheeting into an at least partial end membrane, means for lifting the main closure panel to strip it from the said membrane, means for infolding the gussets and the flange closure panel, means for downfolding the stripped main closure panel and means for sealing down the said downfolded main closure panel.

Figure 2:
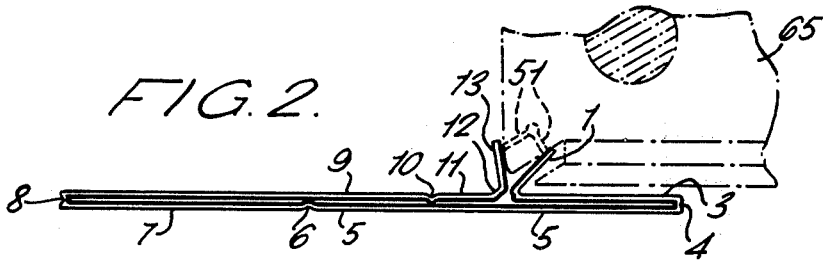
Figure 3:
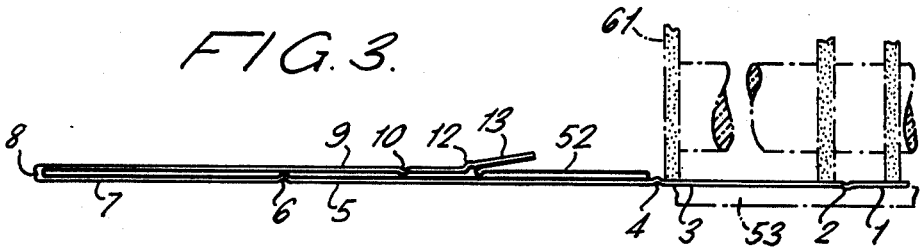

In order that the invention may be more readily understood, reference will now be made to the accompanying drawings which are given by way of example and in which:

FIG. 1 is a plan view as seen from the substratum surface of an end of a blank formed from a lamination, the illustrated end being capable of defining the top part of a pack or package; insets A, B and C show suitable laminations in enlarged cross section, FIG. 2 is an end elevation showing the blank folded and in relation to a heating device, FIG. 3 is an end elevation showing the folded blank, a portion of which has been delaminated, and is having adhesive applied thereto, FIG. 4 is an isometric view of one end of the blank seamed and showing a tube of sheeting within a tube of a substratum.

Figure 12:
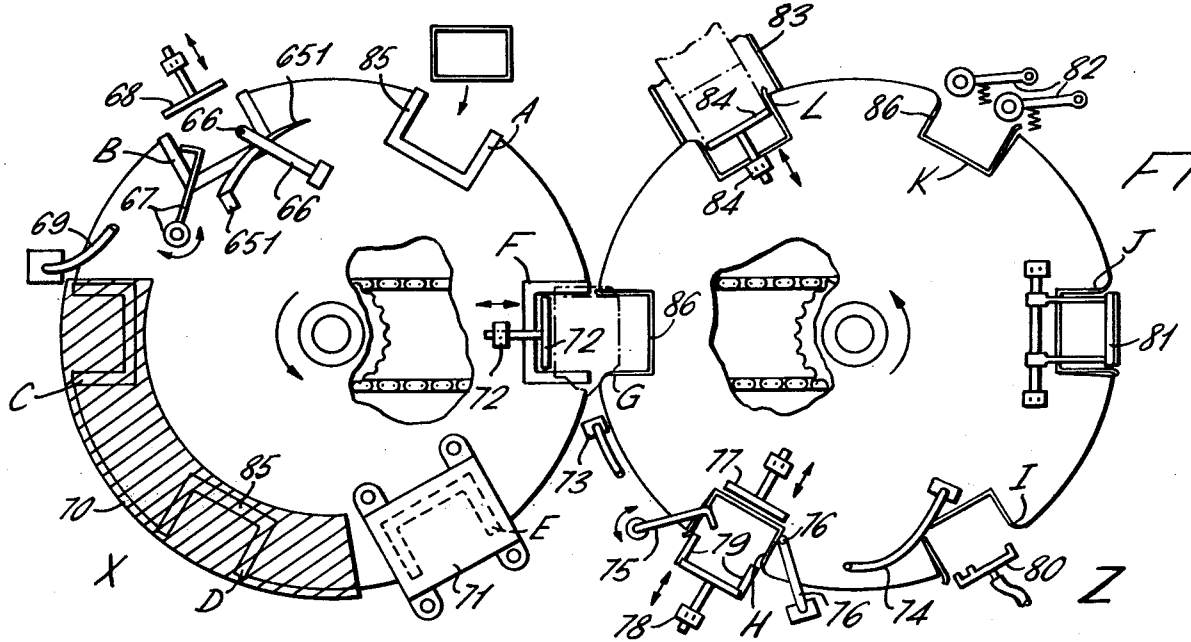

FIG. 5 shows a U-shaped pocket member that assists in transporting the tube and cooperates therewith for sealing, a plurality of which pockets are shown in the lefthand turret in FIG. 12.

Figure 8:
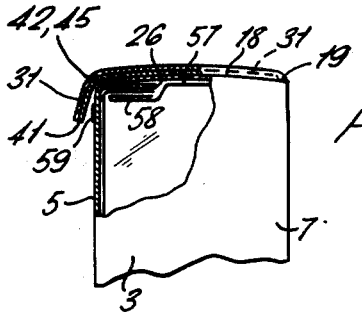
Figure 9:
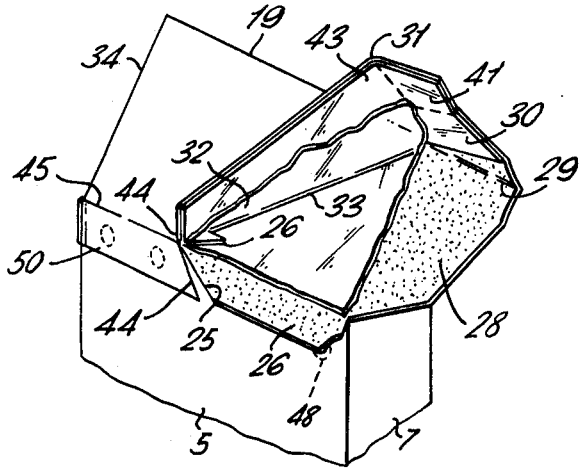
Figure 10:
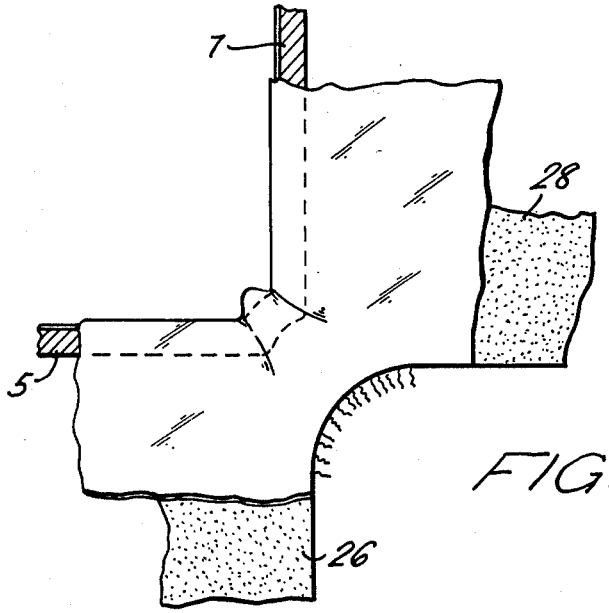
Figure 11:
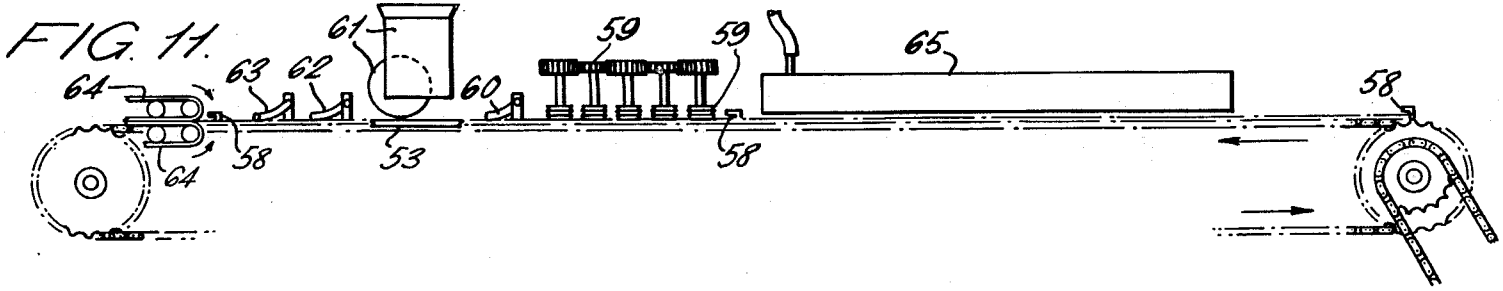

FIG. 6 is a plan view of the tube in the pocket, portions of the closure being broken away to show pack details in relation to the pocket of FIG. 5, FIG. 7 is an isometric view of one end of the pack after a membrane has been delaminated from certain closure panels, a portion of the membrane being broken away for clarity, FIG. 8 is an elevation of the side of the pack with a corner broken away to reveal interior details, FIG. 9 is an isometric view of one end of the pack showing a corner thereof opened ready for dispensing, FIG. 10 is an enlargement of one of the minute corner webs which overlie the pocket corners, FIG. 11 is an elevation of a side seaming apparatus shown schematically, and, FIG. 12 is a plan view of an end sealing apparatus shown schematically.

One end of a typical blank is shown in FIG. 1 formed from a lamination and the remote end (unshown) may be generally or identically similar. Inset A shows a suitable lamination comprising a substratum *a* to which is adhered a heat sealable sheeting *b* through the employment of a laminant *c* such as a microcrystalline wax blend. If the sheeting is not inherently thermoplastically adhesive, then a suitable coating can be imparted thereto as shown at *d* in inset B. The preferred coating should lend itself to ready stretching, such as polyethylene. Moreover any lamination may additionally have a moisture resistant thermoplastic coating on the exterior of the substratum as shown at *e* in inset C.

For certain purposes the sheeting may be a very thin and very porous paper (e.g. tissue paper) and in this event it will not require thermoplasticly adhesive characteristics. With such a sheeting, molten wax will wick through the porosity of the fibres and fuse with another pack area similarly heated, both plies being brought into pressure contact.

The terminology of the art, regarding fold, score and crease lines should now be noted. A "score" is a partial cut through the blank board thickness. A "crease" is a deformation permitting the exterior of the substratum to bend away from itself and a "reverse crease" has the opposite effect. It should be noted that creases produce maximum stretching and weakening of the attached sheeting; with scoring there is a minimum of such effect. The reverse creases on the blank are shown in double lines at 2, 12, 29, 33 and 37. All further fold-lines are creases, with the exception of the scores shown as single broken lines at 16, 20, 31, 35, 40 and 42. For convenience, however, further reference to all such various lines will be generally directed simply to "fold-lines". Perforations may also be used.

As shown the body of the blank comprises a first side fin flange panel 1 hingedly connected to a part side panel 3, which together will form parts of a seamed side panel. A face panel 5 is connected thereto by fold line 4, an unseamed side panel 7 is hingedly connected to panel 5 by fold line 6, a face panel 9 is hingedly connected to panel 7 by fold line 8 and a seaming, e.g. adhesive flange, panel 11 is hingedly connected to panel 9 by fold line 10. A further side fin flange panel 13 is hingedly connected to panel 11 by fold line 12. The panels 11 and 13 will also form parts of the aforementioned seamed side panel. Hingedly connected to all of the body panels (by fold lines 14 to 21 inclusive) are an end triangular panel 22, a cover panel 34 and various flange panels. These panels together form a pack closure with a main closure panel dimensioned to overlie the pack end and may conveniently also be referred to as end closure panels or "end fin sealing margins". The various flange closure panels will be individually specified hereinafter as their relevance becomes apparent.

Reference is now made to the lines of severance 24 and 27 which separate a flange closure panel 26 from further flange closure panels 23 and 28. These lines of severance are produced by a cutting knife having a normal cutting edge and also a stepped down cutting edge. The lower knife edge intersects with the fold lines on which the closure panels bend. The lower portion of the knife's profile scores the substratum but does not cut into the adhered sheeting. In certain instances it is advantageous for this knife additionally to deform the substratum by pressing the latter into a creasing matrix or channel. The effect produced by the lines of severance 24 and 27 is pre-conditioning for the formation of a web in the related corners of the pack when the closure panels are subsequently out-folded. As a result of this the sheeting above all the closure panel fold-lines (that connect same to the body panels) is continuous. This is of course important in the packaging of liquids.

In FIG. 2 portions of the folded blank are shown receiving heat from a device 65 with which it is in close proximity. The free ends of side fin flange panels 1 and 13 are splayed away from each other and this position is maintained by hot air under pressure emitted from minute holes 51 in the heating device. Whereas high heat is applied to the interior of side fin panels 13 and 1, lesser heat contacts side panel 3. The blank in its folded condition may be conveyed past this station through the employment of opposed friction belts squeezing the face panels 9 and 5 or, alternatively, the blank may be conveyed by a pusher member gripping the trailing cut edge of the blank. The former method applies more generally to the conversion of standard machines, see FIG. 11.

It should be noted that heat might if desired be introduced to the fin panels 1, 13 if the latter were folded back parallel to the face panels.

The condition shown in FIG. 3 is subsequent to the application of intensive sealing pressure (not shown) which has been applied to the roots of the fin panel 1, 13 such pressure causing the attached sheeting margins to fuse. In this figure sheeting membrane 52 is shown stripped from out-folded and denuded panels 3 and 1. The out-folded panels are supported by a portion of a datum plate 53, and receive from applicator means 61 multiple bands of polyvinyl acetate containing a wax dissolving solvent. These adhesive bands will eventually overlie portions of panels shown in FIG. 1 at 11, 38, 13 and 39, and also re-adhere the sheeting membrane adjacent to fold line 4. If the exterior coating of the blank is thermoplastically adhesive, heat (e.g. flame) may be used to seam the substratum margins together. Panel 13 is positioned into the same plane as face panel 9, thereby back-folding the seamed sheeting margins. Side panel 3 is folded 180° on fold-line 4 after which compression is applied to the lapped joint until a bond is formed.

In FIG. 4 there is shown one end of the seamed blank with portions of the now tubular and continuous sheeting broken away to reveal the tubular and continuous substratum (shown dotted). Also shown is the double ply seam of the substratum. Flange closure panel 26 will subsequently be out-folded on fold lines 16 and 17 and it is preferable that a folding bar initially enter into the slots provided at 49 and only partially back-fold panel 26. The largest corner webs, as described hereinafter, are formed when panel 26 and so-called gussets, as formed by flange closure panels 28 and 30, and 23 and 36, are simultaneously folded into a 90° relationship with the body. An arrow M indicates the direction of travel during processing. (see also FIG. 12 section X, station A).

In FIG. 5 there is shown a U-shaped pocket 85 the top of which is step profiled to exert varying amounts of pressure to the substratum surfaces that will overlie it when the closure panels are fully out-folded. This pocket serves as a pack-conveying member and preferably embraces three body walls; it is also preferred that the interior walls adjacent the highest portion 54 of the stepped profile tightly embrace only select portions of the periphery of the body, particularly the webbed corners. It is preferred that the highest portion 54 of the stepped profile by-pass the side seam of the substratum except at the junction of the side seam and the end seal. At a portion 55 of the pocket the stepped profile is lowered sufficiently to allow for the extra thickness of substratum at the side seam. All toothed configurations shown are lower than the pressure-applying surface at 54, though still making light pressure contact with the substratum. Whereas it is vital that the radii shown at 56 should immediately underlie the corner webs, this tight fit co-operation between the pocket and the pack is not required elsewhere.

In the plan view of FIG. 6 the gussets are shown fully out-folded with portions in contact with the pocket 85. Areas of the cover panel 34 are shown broken away to reveal the pocket corner radii that will underlie the pack webs. The relationship of the pack to the pocket will be as shown in FIG. 6 at the time when the closure comes into proximity (or contact) with a heating member mounted on the end sealing apparatus. (See also FIG. 12, section X, station C).

FIG. 7 shows the delamination of a sheeting end membrane 57, part of which is broken away for clarity. The substratum area that has been stripped of its sheeting is shown dotted. Prior to this condition and subsequent or concurrently with heating, considerable pressure is applied to the pack closure. Obviously, pressure must be applied whilst the sheeting members are disposed to cohesion. Once the sheeting is fused to the underlying flange panels or end fin sealing margins, panel 26 is folded 180° to overlie the membrane. The gussets are then inwardly folded on fold lines 29 and 37 whilst cover panel 34 is closed. (See also FIG. 12, section Z, stations G and H).

In FIG. 8 there is seen at the broken-away portion of side panel 7, one sealing margin 58 of end membrane 57 seamed to the membrane and back folded. A flange defined at one end thereof along a blank fold-line 31 is adhesively secured to face panel 5 by applying dots of "hot-melt". In this way a corner panel 47 connected to panel 36 by fold 46 is adhered to face panel 5. Moreover a said hot melt dot is provided adjacent to a perforated tearline 44, and a further said hot melt dot 59 secures a corner panel 41 to a scored and delaminable circle 48. The top of the pack is shown to be arcuate, but this and other distortions are for ease of comprehension only. (See also FIG. 12, section Z, station J).

In FIG. 9 the pack is shown subsequent to being opened. The folded corner edge of a flange panel or tab 43 has been pulled away from the pack body, peeling off a layer of circle 48 and tearing along perforated line 44 to raise flange panel 43 and leave flange panel 50 still secure and connected to panel 34 by fold 45. Then by back-folding a flange panel 32 which constitutes a cover panel along fold line 33, and thereafter lifting upwards along fold line 29, flange closure panel 26 is accessible to being pulled open. On pulling, a section of panel 26 will break away along a tear line 25.

To open the corner portion of the membrane it is convenient to reposition substratum flange panel 30 into the out-folded position shown in FIG. 6. This will permit a thumb to be pressed under the exposed sheeting area underlying corner panel 41 to pinch the latter so that the fused end fin sealing margins may be torn apart. It should be noted that fold lines 17 and 18 are creases which weaken the line of the sheeting that is to be torn. It should also be noted that fold lines 42 and 31 are scores and this has not materially weakened the sheeting. When separating forces are exerted to the seamed over-lying and underlying flanges or end fin sealing margins it is the weakened underlying portion of the sheeting that rips. The greater strength of the overlying portion of the sheeting preserves its integrity during the stress of opening. The membrane may be reclosed by merely reversing the folding steps of opening.

FIG. 10 is a highly enlarged view of one of the corner webs that exist in a package formed in the manner described. Panels 28 and 26 are shown folded 90° in relation to the body walls constituted by panels 5 and 7. As mentioned earlier a folding bar had partially positioned panel 26 into an angular plane. This angularity was sufficient to allow the contacting closure panels, when folded, to complete the out-folding. It should be noted that the web connection results from the non-severance of the adhered sheeting. Most thermoplastic films and coatings such as polyethylene or the family of polyvinyl chlorides may be readily stretched.

The web that is shown is generally 2 – 3 sq. mm. if the sheeting is unsupported plastic. A web of 1 sq. mm. is typical when plastic coatings are extruded onto a support. The positioning of panel 26 and its laterally adjacent panels, and their rip separation from one another, is facilitated by the score pre-weakening of the substratum. It is of course the position and existence of these corner webs that permits liquid to be packaged.

FIG. 11 shows, in elevation, a highly schematic view of an independent constant motion side seaming mechanism. This side-seamer could, if desired, work in tandem co-operation with the end sealer described hereinafter. Alternatively, and for example only, this device might be a section added to a conventional carton folder-gluer. Such a new section would be introduced and connect the final folding section and the compression section of such equipment.

The following description is concerned primarily with an independent mechanism, and only those parts that carry out a novel function. Omitted are many details of manufacture well known in the art (e.g. pre-folding of boxboard blanks).

The folded blank, with the fin panels angularly prepositioned by conventional means as shown in FIG. 2, and travelling on a said datum plate 53, or a datum conveyor, enters underneath a said heating device 65. The blanks are propelled by multiple pushers 58 having a gripping surface mounted on an endless chain. The gripping surfaces of the pushers and plate 53 cooperate to produce the required gripping pressure for the blank. After the interior portions of the side fin members have been heated, pressure is applied at least to the roots of the fins by opposed rows of chain driven and toothed rollers 59. Immediately thereafter, the delaminable side panel of the blank is out-folded by a folding bar 60 and the substratum is positioned as shown in FIG. 3. Next, an overhead applicator 61 applies bands of adhesive to the stripped substratum, which is supported by datum plate 53. The panels 13 and 3 may then be folded in sequence by additional folding bar members 62 and 63 before the seamed and adhered flattened tube passes between a compression station, shown as opposed and driven belts 64. It would be at this stage (in connection with the standard manufacture of cartons) that the flat-folded tube would leave the novel section just described and be shingled on to a conventional compression conveyor.

Conventional means of heating the blank are numerous, although compressed hot air is preferred. It is important to note that because of the angularity of the side fin produced by side fin panels 1 and 13 in relation to the flat parallelism of the face panels, it is possible to guide the blank with positive gripping means whilst heat sealing. This also permits twist resistant guidance along a straight linear path whilst other parts of the blank pass through multiple processing stations.

The gripping means may be opposed friction belts as is common on carton blank "folder-gluer" apparatus.

FIG. 12 is a schematic view (shown in plan) of an end sealing machine which comprises a pair of synchronized intermittently rotating turrets at sections X and Z respectively. The turret at Section X has attached thereto pocket members 85 as described with reference to FIG. 5 and disposed around the turret rotation paths are a number of stations.

A flat folded package is opened into a rectangular tube and is introduced into the said pocket at a first station A. Between stations A and B flange panel 26 may be positioned outwardly by a folding bar 651, the direction of pocket and turret travel having panels 28 and 30 trailing. Upon arrival of the package at station B an angularly positioned 45° springloaded member 66 engages fold line 29 imparting an outward (gusset) setting to the trailing side panels. Simultaneously a pivoting forming member 67 contacts the interior surface along fold line 37. A further folding member 68 simultaneously strokes cover panel 34, along fold line 19. This imparts a partial out-folded configuration to the end of the package so that a folding bar 69, positioned between stations B and C, may complete the out-folding of all closure panels. At stations C and D the pack will be in sliding contact with a heater 70 shown as a shaded area. At station E a pressure device 71 will squeeze the closure panels and this pressure may be accompanied by heat in those instances where the exterior coating of the packages is not thermoplastic. If the pack, however, has an exterior coating such as polyethylene the pressure applied at station E will generally be cold. At station F the pack is ejected from the pocket by a pusher 72 to a waiting pocket on the Z section turret.

The pockets employed in the Z section turret are U-shaped sheet metal holders 86, one side wall of which should exert light spring-like pressure onto the package to prevent slipping. The in-feed station to the Z section is designated G. Between stations G and H flange panel 26 is restored to its root position by a rail member 73 and the same rail may lift the cover panel 34 to a position similar to that shown in FIG. 7. At station H flange panel 26 is folded inwards to overlie the top of the box, the trailing side gusset being struck by a pivoting tucking member 75. A spring loaded member 76 abuts fold-line 29 whilst a further folding member 77 folds cover panel 34.

It should be noted that a folding member 78 which positions flange panel 26 at 90° should also incorporate side blade members 79 to overlie panel 26 and also abut the inside of fold line 18 on one side of the package and fold lines 15 and 14 on the other side of the package. These blade members may be instantly removed after the gusset configurations make the transition from the slightly out-folded to slightly in-folded position.

Between stations H and I a folding bar 74 depresses the cover panel 34 into its fully flattened relationship with respect to the body of the carton. At station I a pneumatic hot melt applicator 80 with a nozzle applies the hot melt pattern referred to earlier. At station J a device 81 oscillates (in the vertical plane) to press against the top of the cover panel and to bring the pack flange, which it is also folding, in contact with the hot melt adhesive. At station K spot compression may be provided by spring loaded rollers 82 to the cover panel flange formed by the flange panels 43 and 50, completing the adhesive bond. At station L the package is ejected onto outfeed plate 83 by a pusher 84.

What has just been described is apparatus for forming one end (top) seal of a package and carrying out the package assembly process. To employ this apparatus commercially, the package, which in the first instance has only one end sealed by a first trip through the apparatus, is filled. The filled package is then reintroduced into station A for a second trip through the apparatus, thereby producing a wholly sealed filled package. Alternatively and preferably, to avoid splashing the package is filled via a constricted orifice or spout defined by an incompletely seated and sealed cover panel 34. After filling, seating and sealing is completed.

The end-sealing apparatus of FIG. 12 embodies certain principles that could readily be incorporated into certain standard packaging machines such as certain cartoners. The conversion of these machines involves removing the tools and package carrying pockets from the chassis and replacing them as required. Other than these modifications, the major sections of a cartoner could be wholly employed or modified to carry out the work described herein. In certain instances the side seaming apparatus described herein (FIG. 11) could be used in-line and in synchronization with an end sealer effecting top and bottom seals. This would permit the automatic manufacture of a fully erected package starting with a blank fed from a magazine. What is common to both the side seaming and end sealing apparatus is that each provide means that will ensure parallelism to the body face panels of the substratum whilst other panels are being processed, particularly heating and applying pressure to panel fin members which are angularly disposed in relation to these parallel body faces.

It is to be noted as preferred that — especially where conventional folder-gluers are used — the heat used for delamination should be applied at as early a stage as possible e.g. heating should ideally commence either within the magazine therefor or as soon as the blank emerges from the magazine. This is because it is necessary for the wax viscosity to be reduced and to be absorbed by the porous board material and this requires heat transfer and a period of time.

I claim:

1. A generally tubular package formed from a blank with heat-sealable characteristics, which blank is formed from laminated material comprising a substratum and sheeting de-laminably adhered to said substratum by a heat-weakenable laminant, said sheeting having a stretchable thermoplastic surface, said blank having parallel fold lines which define front and rear body walls and a pair of opposed body side walls and having end closure panel means hingedly connected to one end of each body wall, said blank also having a flange panel hingedly connected to one said body wall at a lateral edge of said blank, said flange panel being connected to another part of said blank at the other lateral edge to form said blank into a tubular package, said end closure panel means including a main closure panel hinged to said rear wall closing the opening at said one end of said tubular package, including flanking gusset panels hinged respectively to said main closure panel and to one of said body side walls and being outfolded to lie in the plane of said main closure panel, and including a flange closure panel hinged to said front wall, tab means connected to the front edge of said main closure panel and lying in said plane of said main closure panel, and corner panels disposed between said gusset panel means and said tab means, said sheeting surface of said blank between each of said outfolded gusset panel means and said flange closure panel being stretched outward therebetween, the sheeting surface of said outfolded gusset panel means being heat-sealed to itself, the sheeting surface of said tab means being heat-sealed to the sheeting surface of said flange closure panel, and said outward stretched sheeting surface being heat-sealed to the sheeting surface of said corner panels to totally seal the end of said closed tubular package, and said main closure panel and its attached gusset panel means and tab means being delaminated from the respective sheeting surfaces thereof.

2. A package in accordance with claim 1 wherein said flange closure panel and said gusset panel means are infolded, said main closure panel is downfolded over said infolded panels, and said tab means is adhesively joined to the outer surface of said front body wall.

3. A package in accordance with claim 2 wherein one of said gusset panel means is infolded about a fold line extending at an angle of about 45° from the corner where it meets said body walls and said main closure panel, wherein said main closure panel contains a diagonal fold line lying substantially directly above said gusset fold line, wherein said infolded flange closure panel contains a line of weakness extending therethrough which lies substantially directly below said gusset fold line, and wherein said tab means contains a line of weakness extending therethrough to the point of intersection of said diagonal fold line and the hinge line between said tab means and said main closure panel.

4. A blank with heat-sealable characteristics suitable for packaging, said blank being formed from laminated material comprising a substratum and sheeting de-laminably adhered to said substratum by a moisture-resistant heat-weakenable laminant, said sheeting surface having cohesive characteristics when heated; said blank having parallel fold lines defining at least two pairs of opposable body walls and having end closure panel means hingedly connected to one end of each body wall along a line perpendicular to said parallel fold lines, additional parallel fold lines at both lateral edge areas of the blank defining flange panels which are hingedly connected to said body wall portions of said blank, said blank being proportioned so that when it is folded into flattened tubular shape said flange panels can be disposed in surface-to-surface contact with each other at a substantial angle to the plane of said flattened tube to create a fin-type side seam by the application of heat and pressure, which side seam forms said blank into tubular configuration.

5. A blank as defined in claim 4 wherein said blank comprises, as said body walls, two face panels each hinged along one lateral edge to one side panel and a pair of partial side panels hinged to the other lateral edge of each of said face panels, said flange panels being hinged along said additional fold lines to said partial side panels.

6. A blank as defined in claim 4 wherein said end closure panel means includes a main closure panel proportioned to close the opening at one end of the tubular package, flanking lateral gusset panel means hinged to said main closure panel and a flange closure panel connected to said body panel opposed to said body panel to which said main closure panel is connected, the substratum of said flange closure panel being at least almost wholly laterally severed from said gusset panel means but the sheeting thereof being interconnected with the sheeting of said gusset panel means.

7. A blank as defined in claim 6 wherein said main closure panel has a front tab hinged thereto having approximately the same dimensions of said flange closure panel.

8. A blank as defined in claim 4 wherein said sheeting is thin porous paper.

9. A blank with heat-sealable characteristics suitable for packaging, said blank being formed from laminated material comprising a substratum and sheeting de-laminably adhered to said substratum by a heat-weakenable laminant, said sheeting having a stretchable thermoplastic surface, said blank having parallel fold lines which define front and rear body walls and a pair of opposed side body walls and having end closure panel means hingedly connected to one end of each body wall, said blank also having a flange panel which is hingedly connected to one said body wall at a lateral edge of said blank for forming said blank into a tubular package, and said end closure panel means including a main closure panel hinged to said rear wall and proportioned to close the opening at one end of the tubular package, flanking gusset panels hinged respectively to said main closure panel and to one of said side body walls, and a flange closure panel connected to said front wall, the substratum of said flange closure panel being partially severed from the substratum portion of said gusset panel means along a line which is an extension of said parallel fold line while the sheeting portion thereof remains connected to the sheeting portion of said gusset panel means for forming a heat-sealed joint outward of the corners of the closed tubular package, and said main closure panel also having tab means hinged to the front edge thereof and corner panel means which are hinged to said tab means and to said gusset panel means.

10. A blank in accordance with claim 9 wherein one of said gusset panel means contains a fold line extending at an angle of about 45° from the corner where it meets said body walls and said main closure panel, wherein said main closure panel contains a diagonal fold line which is located to lie substantially directly above said gusset fold line in the closed tubular package, wherein said flange closure panel contains a line of weakness extending therethrough which lies substantially directly below said gusset fold line in the closed tubular package, and wherein said tab means contains a line of weakness extending therethrough to the intersection of said diagonal fold line and the hinge line between said main closure panel and said tab means.

* * * * *